US007836975B2

(12) United States Patent
Chen et al.

(10) Patent No.: US 7,836,975 B2
(45) Date of Patent: Nov. 23, 2010

(54) MORPHABLE BIT

(75) Inventors: Kuo-Chiang Chen, Lexington, MA (US); Geoff Downton, Sugar Land, TX (US)

(73) Assignee: Schlumberger Technology Corporation, Cambridge, MA (US)

( * ) Notice: Subject to any disclaimer, the term of this patent is extended or adjusted under 35 U.S.C. 154(b) by 85 days.

(21) Appl. No.: 11/923,160

(22) Filed: Oct. 24, 2007

(65) Prior Publication Data

US 2009/0107722 A1 Apr. 30, 2009

(51) Int. Cl.
*E21B 10/38* (2006.01)

(52) U.S. Cl. ..... 175/266; 175/267

(58) Field of Classification Search ..... 175/57, 175/61, 25, 266, 267

See application file for complete search history.

(56) References Cited

U.S. PATENT DOCUMENTS

| | | | | |
|---|---|---|---|---|
| 1,810,201 | A * | 6/1931 | Campbell | 175/266 |
| 4,836,301 | A | 6/1989 | Van Dongen et al. | |
| 4,940,097 | A * | 7/1990 | Martini | 175/296 |
| 5,113,953 | A | 5/1992 | Noble | |
| 5,115,880 | A * | 5/1992 | Sallas et al. | 181/106 |
| 5,216,917 | A | 6/1993 | Detournay | |
| 5,265,682 | A | 11/1993 | Russell et al. | |
| 5,289,875 | A * | 3/1994 | Stokley et al. | 166/264 |
| 5,520,255 | A | 5/1996 | Barr et al. | |
| 5,553,678 | A | 9/1996 | Barr et al. | |
| 5,553,679 | A | 9/1996 | Thorp | |
| 5,582,259 | A | 12/1996 | Barr | |
| 5,603,385 | A | 2/1997 | Colebrook | |
| 5,671,816 | A | 9/1997 | Tibbitts | |
| 5,673,763 | A | 10/1997 | Thorp | |
| 5,685,379 | A | 11/1997 | Barr et al. | |
| 5,695,015 | A | 12/1997 | Barr et al. | |
| 5,706,905 | A | 1/1998 | Barr | |
| 5,720,355 | A | 2/1998 | Lamine et al. | |
| 5,778,992 | A | 7/1998 | Fuller | |

(Continued)

FOREIGN PATENT DOCUMENTS

| | | | |
|---|---|---|---|
| EP | 0530045 | A | 3/1993 |

(Continued)

OTHER PUBLICATIONS

Patent Cooperation Treaty, International Search Report, dated Apr. 22, 2009, 4 pages.

*Primary Examiner*—Daniel P Stephenson
(74) *Attorney, Agent, or Firm*—Brigid Laffey; Vincent Loccisano; James McAleenan

(57) ABSTRACT

A bottom hole assembly for drilling a cavity including a chassis configured to rotate is provided. The chassis may include a conduit, a circuit, a pressure transfer device, a plurality of pistons, a plurality of valves, and a plurality of cutters. The conduit may accept a first flow of a primary fluid. The circuit may have a second flow of a secondary fluid. The pressure transfer device may be configured to transfer pressure between the flows. The pistons may be operably coupled with the circuit, and each piston may be configured to move based at least in part on a pressure of the circuit at that piston, with the valves possibly configured to control a pressure of the circuit at each piston. Each cutter may be coupled with one of the pistons.

22 Claims, 3 Drawing Sheets

U.S. PATENT DOCUMENTS 5,803,185 A 9/1998 Barr et al.
5,971,085 A 10/1999 Colebrook
5,993,358 A * 11/1999 Gureghian et al. ..... 482/54
6,089,332 A 7/2000 Barr et al.
6,092,610 A 7/2000 Kosmala et al.
6,109,370 A 8/2000 Gray
6,142,250 A 11/2000 Griffin et al.
6,158,529 A 12/2000 Dorel
6,244,361 B1 6/2001 Comeau et al.
6,257,356 B1 * 7/2001 Wassell ..... 175/61
6,364,034 B1 4/2002 Schoeffler
6,394,193 B1 5/2002 Askew
6,401,842 B2 6/2002 Webb et al.
6,463,736 B1 * 10/2002 Pohl et al. ..... 60/326
6,488,104 B1 * 12/2002 Eppink et al. ..... 175/61
6,547,017 B1 4/2003 Vail, III
6,568,470 B2 5/2003 Goodson, Jr. et al.
6,698,538 B2 3/2004 Kristiansen et al.
6,714,138 B1 3/2004 Turner et al.
6,814,162 B2 11/2004 Moran et al.
6,962,217 B1 11/2005 Vail, III
7,083,010 B2 * 8/2006 Eppink et al. ..... 175/325.2
7,198,119 B1 * 4/2007 Hall et al. ..... 175/57
7,287,605 B2 * 10/2007 Van Steenwyk et al. ..... 175/61
7,308,944 B2 12/2007 Johnston et al.
7,308,957 B2 12/2007 Cariveau et al.
7,314,099 B2 * 1/2008 Dewey et al. ..... 175/57
7,377,333 B1 * 5/2008 Sugiura ..... 175/45
7,493,971 B2 * 2/2009 Nevlud et al. ..... 175/266
7,516,792 B2 * 4/2009 Lonnes et al. ..... 166/308.1
2001/0052428 A1 12/2001 Larronde et al.
2002/0011359 A1 1/2002 Webb et al.
2003/0010532 A1 1/2003 Kristiansen et al.
2003/0127235 A1 * 7/2003 Dannigkeit ..... 172/2
2003/0183424 A1 10/2003 Tulloch
2005/0056463 A1 3/2005 Aronstam et al.
2005/0132794 A1 6/2005 Spross et al.
2005/0145417 A1 * 7/2005 Radford et al. ..... 175/57
2006/0015257 A1 1/2006 Hassan et al.
2006/0096786 A1 * 5/2006 Wells ..... 175/267
2007/0114064 A1 5/2007 Hall et al.
2007/0205022 A1 9/2007 Treviranus et al.
2008/0060710 A1 * 3/2008 Carlson et al. ..... 137/807
2008/0105465 A1 * 5/2008 Radford et al. ..... 175/57

FOREIGN PATENT DOCUMENTS

EP 0646693 A2 4/1995
EP 0770760 A 5/1997
EP 0677640 B1 9/1999
EP 0646693 B1 1/2000
EP 0686752 B1 5/2000
EP 1275815 A1 1/2003
GB 2393748 A 4/2004
WO 2259316 A 3/1993
WO 01/25586 A1 4/2001
WO 01/81708 A1 11/2001
WO 02/29441 A1 4/2002
WO 03/002840 A2 1/2003
WO 2005/028805 A1 3/2005
WO 2006/022922 A1 3/2006

* cited by examiner

MORPHABLE BIT

BACKGROUND OF THE INVENTION

This invention relates generally to drilling. More specifically the invention relates to drilling directional holes in earthen formations.

Directional drilling is the intentional deviation of the wellbore from the path it would naturally take. In other words, directional drilling is the steering of the drill string so that it travels in a desired direction.

Directional drilling is advantageous in offshore drilling because it enables many wells to be drilled from a single platform. Directional drilling also enables horizontal drilling through a reservoir. Horizontal drilling enables a longer length of the wellbore to traverse the reservoir, which increases the production rate from the well.

A directional drilling system may also be used in vertical drilling operation as well. Often the drill bit will veer off of a planned drilling trajectory because of the unpredictable nature of the formations being penetrated or the varying forces that the drill bit experiences. When such a deviation occurs, a directional drilling system may be used to put the drill bit back on course.

Known methods of directional drilling include the use of a rotary steerable system ("RSS"). In an RSS, the drill string is rotated from the surface, and downhole devices cause the drill bit to drill in the desired direction. Rotating the drill string greatly reduces the occurrences of the drill string getting hung up or stuck during drilling.

Rotary steerable drilling systems for drilling deviated boreholes into the earth may be generally classified as either "point-the-bit" systems or "push-the-bit" systems. In the point-the-bit system, the axis of rotation of the drill bit is deviated from the local axis of the bottom hole assembly ("BHA") in the general direction of the new hole. The hole is propagated in accordance with the customary three-point geometry defined by upper and lower stabilizer touch points and the drill bit. The angle of deviation of the drill bit axis coupled with a finite distance between the drill bit and lower stabilizer results in the non-collinear condition required for a curve to be generated. There are many ways in which this may be achieved including a fixed bend at a point in the BHA close to the lower stabilizer or a flexure of the drill bit drive shaft distributed between the upper and lower stabilizer. In its idealized form, the drill bit is not required to cut sideways because the bit axis is continually rotated in the direction of the curved hole. Examples of point-the-bit type rotary steerable systems, and how they operate are described in U.S. Patent Application Publication Nos. 2002/0011359; 2001/0052428 and U.S. Pat. Nos. 6,394,193; 6,364,034; 6,244,361; 6,158,529; 6,092,610; and 5,113,953, all of which are hereby incorporated by reference, for all purposes, as if fully set forth herein.

In a push-the-bit rotary steerable, the requisite non-collinear condition is achieved by causing either or both of the upper or lower stabilizers or another mechanism to apply an eccentric force or displacement in a direction that is preferentially orientated with respect to the direction of hole propagation. Again, there are many ways in which this may be achieved, including non-rotating (with respect to the hole) eccentric stabilizers (displacement based approaches) and eccentric actuators that apply force to the drill bit in the desired steering direction. Again, steering is achieved by creating non co-linearity between the drill bit and at least two other touch points. In its idealized form the drill bit is required to cut side ways in order to generate a curved hole. Examples of push-the-bit type rotary steerable systems, and how they operate are described in U.S. Pat. Nos. 5,265,682; 5,553,678; 5,803,185; 6,089,332; 5,695,015; 5,685,379; 5,706,905; 5,553,679; 5,673,763; 5,520,255; 5,603,385; 5,582,259; 5,778,992; 5,971,085, all of which are hereby incorporated by reference, for all purposes, as if fully set forth herein.

Known forms of RSS are provided with a "counter rotating" mechanism which rotates in the opposite direction of the drill string rotation. Typically, the counter rotation occurs at the same speed as the drill string rotation so that the counter rotating section maintains the same angular position relative to the inside of the borehole. Because the counter rotating section does not rotate with respect to the borehole, it is often called "geo-stationary" by those skilled in the art. In this disclosure, no distinction is made between the terms "counter rotating" and "geo-stationary."

A push-the-bit system typically uses either an internal or an external counter-rotation stabilizer. The counter-rotation stabilizer remains at a fixed angle (or geo-stationary) with respect to the borehole wall. When the borehole is to be deviated, an actuator presses a pad against the borehole wall in the opposite direction from the desired deviation. The result is that the drill bit is pushed in the desired direction

BRIEF DESCRIPTION OF THE INVENTION

In one embodiment, a bottom hole assembly for drilling a cavity is provided. The bottom hole assembly may include a chassis configured to rotate. The chassis may include a primary fluid conduit, a secondary fluid circuit, a pressure transfer device, a plurality of pistons, a plurality of valves, and a plurality of cutters. In some embodiments, a plurality of snubbers may also be included. The primary fluid conduit may be configured to accept a first fluid flow. The secondary fluid circuit may have a second fluid flow. The pressure transfer device may be configured to transfer pressure between the first fluid flow and the second fluid flow. The plurality of pistons may be operably coupled with the secondary fluid circuit, where the plurality of pistons may include a first piston, and the first piston may be configured to move based at least in part on a pressure of the secondary fluid circuit at the first piston. The plurality of valves may be operably coupled with the secondary fluid circuit, where the plurality of valves may be configured to control a pressure of the secondary fluid circuit at each of the plurality of pistons. The plurality of cutters may be in proximity to an outer surface of the chassis, where each of the plurality of cutters may be coupled with one of the plurality of pistons.

In another embodiment, a method for drilling a cavity in a medium is provided. The method may include providing a chassis having a plurality of cutters, where each of the plurality of cutters may be extendable from, and retractable to, the chassis. The plurality of cutters may include a first cutter. The method may also include rotating the chassis in the medium, where the plurality of extendable and retractable cutters may remove a portion of the medium to at least partially define the cavity. The method may also include extending the first cutter from the chassis during the rotation of the chassis in the medium.

In another embodiment, a system for drilling a cavity in a medium is provided. The system may include a plurality of cutters, a first means, a second means, and a third means. The first means may be for rotating the plurality of cutters in a medium. The second means may be for selectively extending and retracting each of the plurality of cutters. The third means may be for powering the second means.

BRIEF DESCRIPTION OF THE DRAWINGS

The present invention is described in conjunction with the appended figures.

Figure 1:
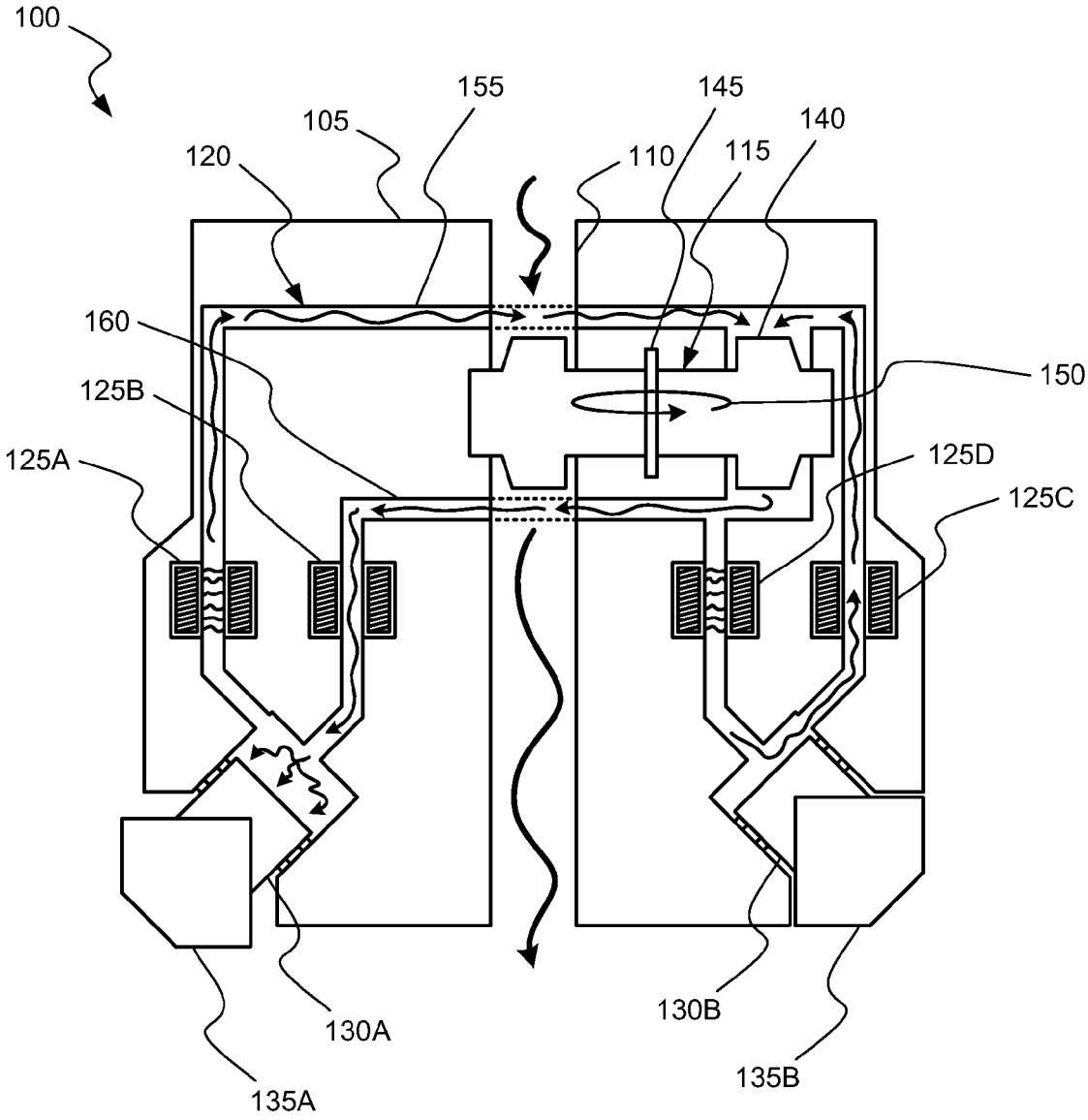
FIG. 1 is a sectional side view of a system of the invention for drilling a cavity in a medium.

In the appended figures, similar components and/or features may have the same numerical reference label. Further, various components of the same type may be distinguished by following the reference label by a letter that distinguishes among the similar components and/or features. If only the first numerical reference label is used in the specification, the description is applicable to any one of the similar components and/or features having the same first numerical reference label irrespective of the letter suffix.

DETAILED DESCRIPTION OF THE INVENTION

The ensuing description provides exemplary embodiments only, and is not intended to limit the scope, applicability or configuration of the disclosure. Rather, the ensuing description of the exemplary embodiments will provide those skilled in the art with an enabling description for implementing one or more exemplary embodiments. It being understood that various changes may be made in the function and arrangement of elements without departing from the spirit and scope of the invention as set forth in the appended claims.

Specific details are given in the following description to provide a thorough understanding of the embodiments. However, it will be understood by one of ordinary skill in the art that the embodiments may be practiced without these specific details. For example, systems, processes, and other elements in the invention may be shown as components in block diagram form in order not to obscure the embodiments in unnecessary detail. In other instances, well-known processes, structures, and techniques may be shown without unnecessary detail in order to avoid obscuring the embodiments.

Also, it is noted that individual embodiments may be described as a process which is depicted as a flowchart, a flow diagram, a structure diagram, or a block diagram. Although a flowchart may describe the operations as a sequential process, many of the operations can be performed in parallel or concurrently. In addition, the order of the operations may be re-arranged. A process may be terminated when its operations are completed, but could have additional steps not discussed or included in a figure. Furthermore, not all operations in any particularly described process may occur in all embodiments. A process may correspond to a method, a function, a procedure, etc.

Furthermore, embodiments of the invention may be implemented, at least in part, either manually or automatically. Manual or automatic implementations may be executed, or at least assisted, through the use of machines, hardware, software, firmware, middleware, microcode, hardware description languages, or any combination thereof. When implemented in software, firmware, middleware or microcode, the program code or code segments to perform the necessary tasks may be stored in a machine readable medium. A processor(s) may perform the necessary tasks.

In one embodiment of the invention, a system for drilling a cavity may be provided. The system may be a bottom hole assembly. The system may include a chassis configured to rotate. The chassis may include a primary fluid conduit, a secondary fluid circuit, a pressure transfer device, a plurality of pistons, a plurality of valves, and a plurality of cutters.

In some embodiments, the primary fluid conduit may be configured to accept a first fluid flow. Merely by way of example, the primary fluid conduit may be coupled with drill pipe or drill tube. In some embodiments, the first fluid flow may include mud or other working fluid, both for lubricating, cleaning, cooling the bit and cavity, and possibly for providing a fluid power source for a mud motor or other equipment in the bottom hole assembly.

In some embodiments, the secondary fluid circuit may have a second fluid flow. In one embodiment, the second fluid circuit may be a substantially closed loop circuit. Merely by way of example, the second fluid flow may include a smart fluid material. In an exemplary embodiment, such smart fluid materials may include magnetorheological or electrorheological fluids.

In some embodiments, the pressure transfer device may be configured to transfer pressure between the first fluid flow and the second fluid flow. In one embodiment, the pressure transfer device may include a fluid driven pump, where the fluid driven pump is powered by the first fluid flow and thereby pressurized the second fluid flow.

In some embodiments, the fluid driven pump may include a turbine. In one embodiment, the turbine may be operably coupled with both the primary fluid conduit and the secondary fluid circuit. Merely by way of example, the turbine may be configured to be rotate by the first fluid flow and to thereby pressurize the second fluid flow with which the turbine is operably coupled.

In some embodiments, the plurality of pistons may be operably coupled with the secondary fluid circuit. In one embodiment, any one of the plurality of pistons may be configured to move, based at least in part on a pressure of the secondary fluid circuit at that particular piston.

Merely by way of example, if the pressure of the secondary fluid circuit at a particular piston is elevated, that particular piston may extend outward, possibly away from the chassis. In another example, if the pressure of the secondary fluid circuit at a particular piston is reduced, that particular piston may retract inward, possibly toward the chassis.

In some embodiments, the plurality of valves may be operably coupled with the secondary fluid circuit. In one embodiment, the plurality of valves may be configured to control a pressure of the secondary fluid circuit at each of the plurality of pistons. Merely by way of example, each particular piston may have associated with it one or more valves which, possibly in concert with other valves, may be controlled to change or maintain the pressure of the secondary fluid circuit at the particular piston.

In some embodiments, the valves may be remotely actuated mechanical valves. In an exemplary embodiment, where the secondary fluid flow includes a magnetorheological or electrorheological fluid, the valves may be electrically activated electromagnetic field generators, for example, electric coils surrounding the secondary fluid circuit at a given point in the circuit.

Activation of such electromagnetic filed generators may cause a magnetorheological or electrorheological fluid to increase its viscosity at the valve location such that flow of the fluid is at least reduced, if not stopped. Such exemplary embodiments may be advantageous where high torques may be necessary to shut off flow in a portion of a high pressure secondary fluid circuit.

High pressure secondary fluid circuits may be present where the medium in which the cavity is being drilled is hard and/or strong, for example, earthen formations. Such mediums may exert large forces on extended pistons, especially at the rotational velocities required to cut such mediums, thereby causing high pressures in the secondary fluid circuit coupled thereto.

In some embodiments, the plurality of cutters may be in proximity to an outer surface of the chassis. In one embodiment, each of the plurality of cutters may be coupled with one of the plurality of pistons. Merely by way of example, each cutter may include a solid fixed cutter, a roller-cone cutter, and/or a polycrystalline diamond compact cutter. Also, in some embodiments, snubbers may be coupled with any of the plurality of pistons to create the reverse effect of drilling (i.e. a lack of drilling when the snubber is extended). For the purposes of this disclosure, it will be assumed that one skilled in the art will now recognize that snubbers may be used in any location where cutters are discussed to produce a reverse effect.

In some embodiments, the system may also include a control system to either automatically, or by manual command, extend and/or retract individual pistons and/or groups of pistons. In some embodiments, the extension and/or retraction of the individual pistons, and hence the cutters coupled with those pistons, may be caused to occur in relation to the rotation of the chassis. The control system may be coupled with the chassis, and components therein either by wire line, wireless or telemetric connection via a drilling fluid in the cavity.

In some embodiments, different sets of cutters may be employed for different purposes, with remaining sets of cutters retracted until they are needed. Merely by way of example, a first set of cutters may be used for drilling through one type of rock, while another set of cutters may be used for drilling through another type of rock. In some embodiments, the second set of cutters will be substantially the same as the first set, merely being used as a 'replacement" set when the first set becomes worn. Other cutter sets may perform different functions such as drilling through casing. Changing between operation of different sets of cutters may be made either automatically by a monitoring system, or manually by a drilling operator.

Merely by way of example, in some applications, extension and/or retraction of the cutters may be activated at random and/or planned intervals to at least mitigate stick-slip of the bottom hole assembly while drilling. In some embodiments, such systems may allow for responsive activation when stick-slip is encountered in drilling. Merely by way of example, if the medium in which the cavity is being drilled is anisotropic in composition, possibly having different layers having different mechanical properties, extension and/or retraction of the cutters may allow for slower drilling with increased torque, or faster drilling with decreased torque depending on the mechanical properties of a given region of the medium. In these or other embodiments, extension and/or retraction of the cutters may be uniform or semi-uniform in nature.

In other embodiments, directional drilling may be desired. In these embodiments, the chassis may be configured to rotate at a certain rate, and each of the plurality of pistons may be configured to be extended and retracted once during each rotation. Merely by way of example, if the chassis is rotating at 250 rotations per minutes, each piston may be extended and retracted (hereinafter a "cycle") at a rate of 250 cycles per minute. The absolute radial direction position at which each piston is extended may be the same, thereby causing the chassis and cutters to directional drill in that absolute radial direction. This will be discussed in greater detail below with regards to FIGS. 2A, 2B, 2C, 2D, and 3.

In some embodiments, the rotational speed of the chassis may be variable, possibly either due to operational control, or possibly due to a change in the mechanical properties of the mediums in which the drill cutters are passing through. In these or other embodiments, a control system may receive data representing the rotational speed of the chassis and/or the rotational position of the chassis, and control the valves based at least in part on the rotational speed and/or rotational position of the chassis. In this manner, different pistons, and consequently cutters, can be extended in a desired absolute radial direction to cause directional drilling in that direction.

In some embodiments, a control system may also receive data representing the position of any given piston and determine an amount of wear on a cutter coupled with the given piston based at least in part on the position of the given piston. Merely by way of example, if a piston must be extended farther than otherwise normal to achieve contact between the associated cutter and the medium, then the cutter may be worn. Because the cutters are mounted on movable pistons, the location of pistons may provide data to the control system on the state, for example the physical dimensions, of the associated cutters.

In some embodiments, a control system may also determine a delay time between transmission of control signals, voltages, and/or currents (hereinafter, collectively "control signals") to the valves and the change in position of the piston or pistons which such transmission was to effect. By knowing the time controls signals are sent, and the time pistons are moved, a delay time can be determined by the control system. The delay time may be representative of the time it takes control signals to reach the valves, the time it takes the valves to be actuated, the time it takes the fluid to react to actuation of the valve, and the time it takes the pistons to react to the change in pressure of the secondary circuit at the piston.

Future control signals, sent to the chassis to control valves, and by consequence pistons and cutters coupled therewith, may be sent sooner, by an amount substantially equal to the delay time, to compensate for said delay time. Therefore, when it is known that a cutter will need to be extended a certain time, a control signal may be sent at time preceding that time as determined by the delay time. The control system may constantly be determining delay times as a drilling operation occurs and modifying its control signal sequencing to achieve desired extension and/or retraction of the cutters.

In another embodiment of the invention, a method for drilling a cavity in a medium is provided. In some embodiments, the methods performed by any of the systems discussed herein may be provided. In one embodiment, the method may include providing a chassis having a plurality of cutters, where each of the plurality of cutters may be extendable from, and retractable to, the chassis. The method may also include rotating the chassis in the medium, where the plurality of extendable and retractable cutters may remove a portion of the medium to at least partially define the cavity. The method may also include extending at least one of the plurality of cutters from the chassis during the rotation of the chassis in the medium.

In some embodiments, extension and/or retraction of cutters from the chassis may occur sequentially, possibly to allow for directional drilling. Merely by way of example, extending cutters from the chassis during the rotation of the chassis in the medium may include extending a first cutter from the chassis when the first cutter is substantially at a particular absolute radial position. The method may further include retracting the first cutter when the first cutter is not substantially at the particular absolute radial position. The method may also include extending a second cutter from the chassis when the second cutter is substantially at the particular absolute radial position. Finally, the method may also include retracting the second cutter to the chassis when the second cutter is not substantially at the particular absolute radial position. In some embodiments, the method may repeat, thereby causing directional drilling in the absolute radial direction. In other embodiments, any possible number of cutters may be so sequentially operated to allow for directional drilling, with each cutter in a greater number of total cutters possibly doing proportionally less cutting.

In some embodiments, extending a cutter from the chassis during rotation in the medium may include providing a secondary fluid circuit having a second fluid flow, pressurizing the second fluid flow, providing a plurality of pistons operably coupled with the secondary fluid circuit, providing a plurality of valves operably coupled with the secondary fluid circuit, and controlling the plurality of valves to move a piston with which the cutter is coupled. In some of these embodiments, a particular piston may be configured to move based at least in part on a pressure of the secondary fluid circuit at the particular piston, and the plurality of valves may be configured to control a pressure of the secondary fluid circuit at each of the plurality of pistons. In some embodiments, pressuring the second fluid flow may include providing a first fluid flow to the chassis, and transferring pressure from the first fluid flow to the second fluid flow.

In some embodiments, the method for drilling a cavity in a medium may also include receiving data representing the position of the first cutter, and determining an amount of wear of the first cutter based at least in part on the data representing the position of the first cutter. In some embodiments, the systems described herein may be provided to implements at least portions of such a method.

In some embodiments, the method for drilling a cavity in a medium may also include determining a delay time between transmission of control signals and a change in position of a piston or cutter desired to be moved. These methods may include steps of receiving data representing a change in a position of a particular cutter and determining a delay time between transmitting the control signal issued to move the cutter and such movement. Future control signals may be transmitted at an adjusted point in time to compensate for the delay time.

In another embodiment of the invention, a system for drilling a cavity in a medium is provided. The system may include a plurality of cutters, a first means, a second means, and a third means.

In some embodiments, the first means may be for rotating the plurality of cutters in a medium. In one embodiment, the first means may include a chassis, and the chassis may be coupled with the plurality of cutters. The first means may also include a rotational motion source. In these or other embodiments, the first means may also include any structure or other mechanism discussed herein.

In some embodiments, the second means may be for selectively extending and retracting each of the plurality of cutters. In one embodiment, the second means may include a secondary fluid circuit, a plurality of pistons, and a plurality of valves, possibly as described herein. The secondary fluid circuit may have a second fluid flow. The plurality of pistons may be operably coupled with the secondary fluid circuit, where each of the plurality of pistons may be coupled with one of the plurality of cutters, and each piston may be configured to move based at least in part on a pressure of the secondary fluid circuit at that piston. As discussed above, the second means may be "aware" of the rotational position of the first means, therefore allowing extension and retraction of each of the plurality of cutters and/or snubbers as necessary to conduct directional drilling. In these or other embodiments, the second means may also include any structure or other mechanism discussed herein.

In some embodiments, the third means may be for powering the second means. In one embodiment, the third means may include a pressure transfer device. Merely by way of example, the third means may include a primary fluid conduit configured to accept a first fluid flow and a turbine configured to be turned by the first fluid flow. In other embodiments, the third means may include an electrically powered pump which provides power (i.e. pressurization) to the second means. In these or other embodiments, the third means may also include any structure or other mechanism discussed herein.

Turning now to FIG. 1, a sectional side view of a system 100 of the invention for drilling a cavity in a medium is shown. System 100 includes a chassis 105 which has a primary fluid conduit 110, pressure transfer device 115, secondary fluid circuit 120, valves 125A, 125B, 125C, 125D, pistons 130A, 130B, and cutters 135A, 135B. System 100 in FIG. 1 is merely an example of one embodiment of the invention. Though only two cutters 135A, 135B and their related equipment are shown in FIG. 1, in other embodiments, any number of cutters and their related equipment may be implemented. In some embodiments, cutters may be spaced regularly or irregularly around chassis 105.

In some embodiments, chassis 105 may be at least a portion of a bottom hole assembly. Chassis 105 may be configured to rotate about its axis, which, in this example, may be the center of primary fluid conduit 110. Chassis 105 may, merely by example, be coupled with a rotational motion source, possibly at the surface of an earthen drilling, via drill tube or drill pipe.

In some embodiments, a primary fluid may flow through primary fluid conduit 110 and power pressure transfer device 115. In one embodiment, the fluid may be drilling mud, while in other embodiments, any number of gases, liquids or some combination thereof may be employed. In this example, the primary fluid in primary fluid conduit 110 rotates a turbine 140 on a shaft 145 in pressure transfer device 115 as indicated by arrow 150. Turbine 140 may rotate and circulate a second fluid flow in secondary fluid circuit 120.

Secondary fluid circuit includes a low pressure side 155 (shown as arrows headed toward turbine 140) and a high pressure side 160 (shown as arrows headed away from turbine 140). Valves 125 may work with pressure transfer device 115 to increase the pressure of the high pressure side 160 and decrease the pressure of low pressure side 155. In this example, the second fluid in secondary fluid circuit 120 is a magnetorheological fluid (hereinafter "MR fluid") and valves 125 are electrical field generators.

At the point in time shown in the example in FIG. 1, valves 125A, 125D are in a closed state, as the electromagnetic field generated by valves 125A, 125D has caused flow of the MR fluid to cease across that section of secondary fluid circuit 120. Meanwhile, valves 125B, 125C are in an open state. Therefore, at this moment of operation, the high pressure side 160 is causing piston 130A to extend from chassis 105, thereby forcing cutter 135A, which is coupled with piston 130A toward the medium to be cut.

As chassis 105 rotates, cutter 135A may be retracted by opening of valves 125A and 125D, and closing of valves 125B and 125C. In this manner, cutter 135B may be extended in the same absolute radial direction in which cutter 135A was originally extended, thereby causing directional drilling in that absolute radial direction. The process may then repeat itself, with cutter 135A extending as it comes around to the same radial direction.

FIGS. 2A-2D show inverted plan views of a system 200 of the invention for drilling a cavity in a medium during sequential time periods of a directional drilling. In this embodiment, chassis 105 has four cutters 210, each identified by a letter, A, B, C, or D. FIG. 3 shows a sectional side view 300 of the system in FIGS. 2A-2D while directionally drilling.

Figure 2A:
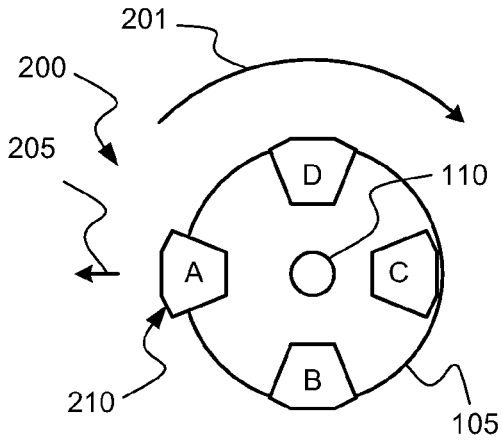
FIGS. 2A-2D are inverted plan views of a system of the invention for drilling a cavity in a medium during sequential time periods of a directional drilling.
Figure 3:
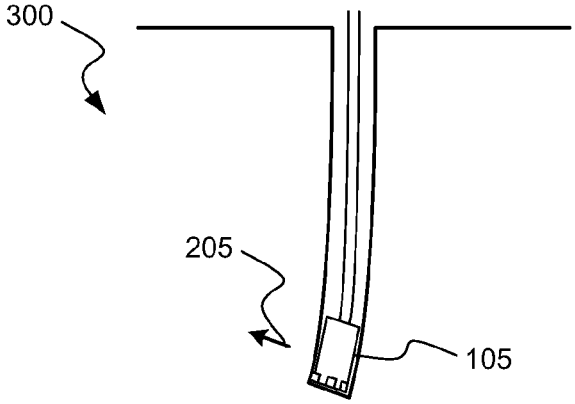
FIG. 3 is a sectional side view of a system of the invention while directionally drilling.

In FIG. 2A, chassis 105 is being rotated in the direction of shown by arrow 201. Cutter A is extended in the direction of an absolute radial direction indicated by arrow 205. Cutter C meanwhile is fully retracted. Cutter B is in the process of being extended, and cutter B is in the process of being retracted.

Figure 2B:
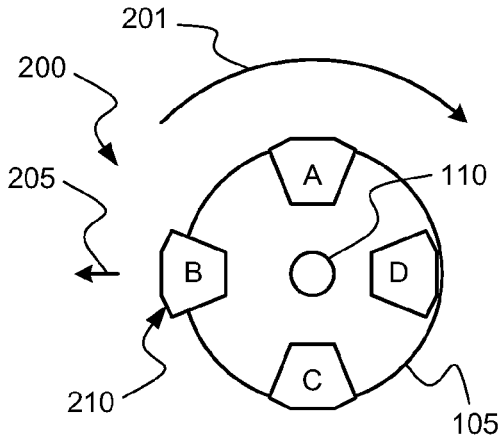

In FIG. 2B, chassis 105 has rotates ninety degrees from FIG. 2A in the direction shown by arrow 201. Now cutter B is fully extended when faces the absolute radial direction indicated by arrow 205. Cutter D meanwhile is fully retracted. Cutter C is in the process of being extended, and cutter A is in the process of being retracted.

Figure 2C:
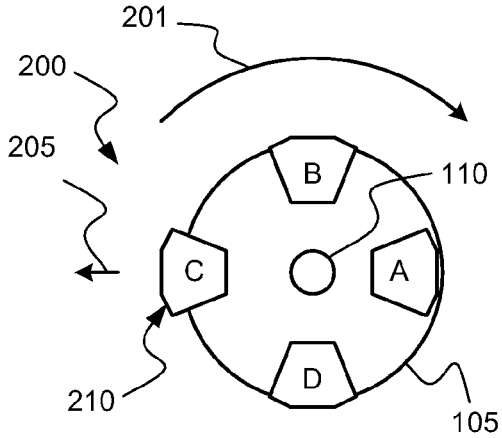

In FIG. 2C, chassis 105 has rotates ninety degrees from FIG. 2B in the direction shown by arrow 201. Now cutter C is fully extended when faces the absolute radial direction indicated by arrow 205. Cutter A meanwhile is fully retracted. Cutter D is in the process of being extended, and cutter B is in the process of being retracted.

Figure 2D:
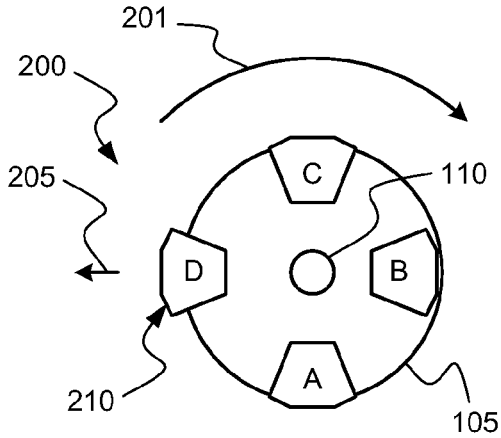

In FIG. 2D, chassis 105 has rotates ninety degrees from FIG. 2C in the direction shown by arrow 201. Now cutter D is fully extended when faces the absolute radial direction indicated by arrow 205. Cutter B meanwhile is fully retracted. Cutter A is in the process of being extended, and cutter C is in the process of being retracted. The process may then be repeated as chassis 105 rotates another 90 degrees presenting cutter A toward the absolute radial direction indicated by arrow 205. Such systems and methods may be used with any number of cutters so as to directionally drill, possibly even in multiple different directions over a varied depth.

Note that the angular position over which cutters 210 may be extended may not, in real applications, be as presented as ideally in FIGS. 2A-2D. In real applications, there may be some steering tool face offset. In these situations, the cutters may be 210 be activated prior to or after the positions shown in FIGS. 2A-2D to achieve direction shown by arrow 205. Automated systems may determine the steering tool face offset necessary to achieve the desired directional drilling and modify instructions to the cutters based thereon. Such automated systems may monitor the effectiveness of a determined tool face offset, and adjust as necessary to continue directional drilling. These systems may be able to differentiate between "noise" fluctuations and real changes.

In FIG. 3, it will be recognized how repeating the process detailed above can result in a directional bore hole. Also recognizable is how the absolute radial direction may slowly change as the angle of bore hole changes due to directional drilling. If directional operation continues, then the bore hole may continue to "curve." Alternatively, once a certain angle of bore hole has been achieved, straight drilling may recommence by allowing the valves in the chassis to equalize the extension of all cutters, causing substantially symmetrical drilling around the perimeter of the chassis and straight bore hole drilling in the then current direction. Additionally, cyclical variation of the cutters may also allow for straighter drilling, especially when boundaries between different earthen formations (particularly steeply dipping formations) are crossed.

Figure 4:
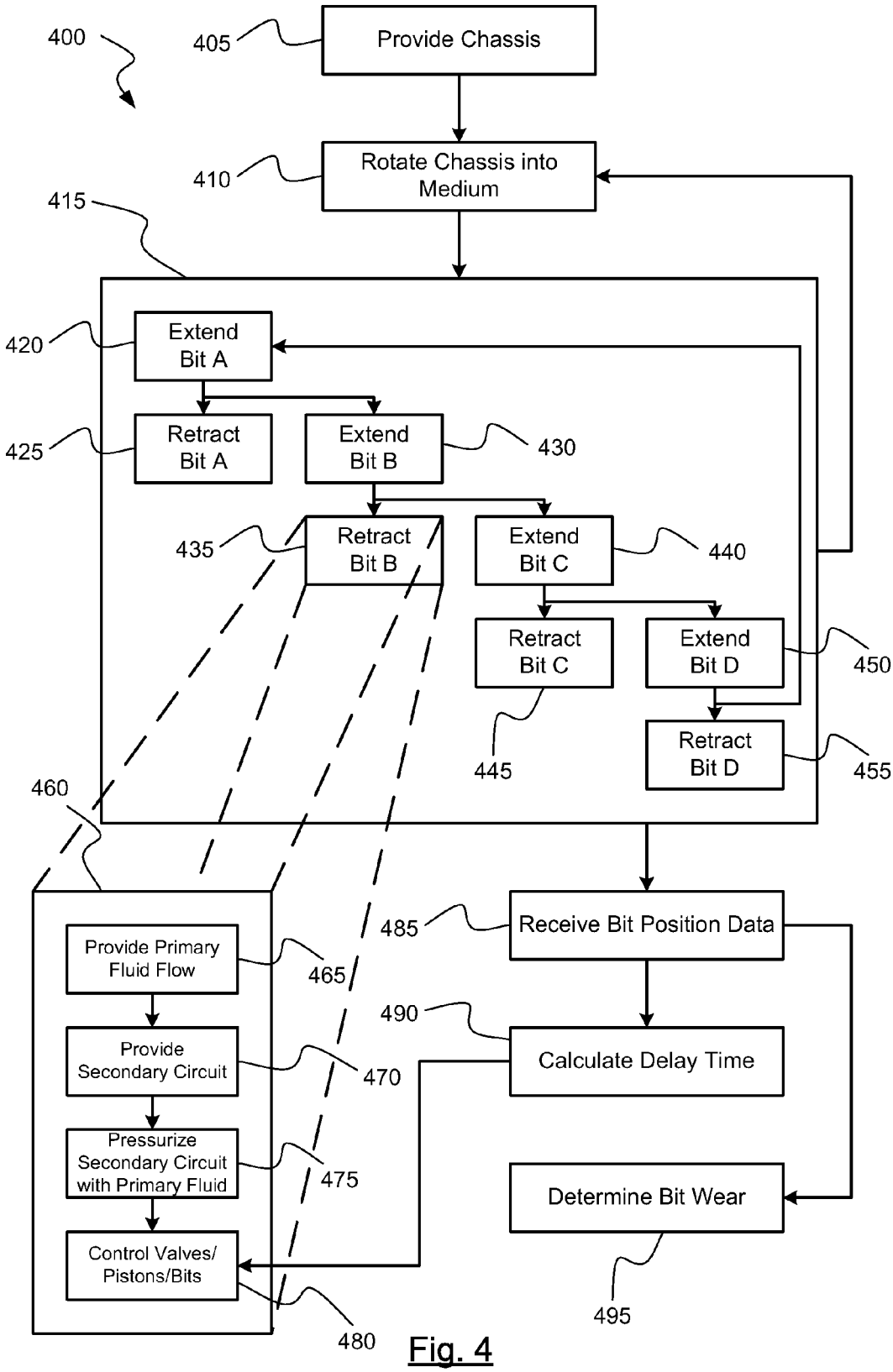
FIG. 4 is a block diagram of one method of the invention for drilling a cavity in a medium.

FIG. 4 shows a block diagram of one method 400 of the invention for drilling a cavity in a medium. At block 405, a chassis is provided. In some embodiments the chassis may be one of the assemblies described herein. At block 410, the chassis is rotated into the medium to be drilled.

At block 415, the extension and retraction process for a four cutter drill embodiment of the invention is shown. During all the processes of block 415, the chassis may be continually rotated. At block 420, cutter A is extended. At block 425 cutter A is retracted while at substantially the same time, cutter B is extended at block 430. The process repeats itself with cutter B retracting at block 435 while at substantially the same time cutter C is extended at block 440. The process repeats itself again with cutter C retracting at block 445 while at substantially the same time cutter D extended at block 450. Finally, the process ends and begins again as cutter D is retracted at block 455 while cutter is extended at block 420. In some embodiments, the entire process in block 415 may repeat itself once per each substantially complete rotation of the chassis at block 410.

At block 460, the process for extending or retracting a cutter is shown. Though FIG. 4 shows block 460 as representing the process of block 435 (the retraction of cutter B), it may represent any extension or retraction of any cutter in the method. At block 465, a primary fluid flow is provided, for example a drilling mud flow. At block 470, a secondary fluid circuit is provided. At block 475, the secondary fluid circuit is pressurized with the primary fluid flow. At block 480, the valves in the secondary circuit are controlled, possibly by a control system, thereby actuating pistons with which cutters are attached, and thereby extending or retracting the associated cutters.

At block 485, a method may receive/obtain cutter position data. In some embodiments, this may be accomplished by obtaining piston position data. At block 490, a delay time, as described herein, may be calculated based at least in part on when commands are issues to the cutter position system, and the response time of the system thereto. A delay time may be continually calculated and inform the controlling of the valves. In some embodiments, individual delay times may be calculated for each particular piston/cutter combination in the system. At block 495, cutter wear may be determined based at least in part the cutter position data. Operators may use such cutter wear data to modify or cease operation of the drilling system. Additionally, other useful information (i.e. the medium's mechanical properties) may be determined from the force required to drive the cutters into the medium, essentially turning the entire bit into an additional source of measurements for cavity (i.e. well bore) properties.

A number of variations and modifications of the invention can also be used within the scope of the invention. For example, levers or other devices may be coupled with the cutters and pistons to allow for controlled angular manipulation of the cutters in addition to the linear extension and retraction of such cutters. In another modification, MR fluid may be monitored via observing current generated by the MR fluid's transition through the electromagnetic valved areas of the secondary fluid circuit. As the MR fluid progresses through its useful life, it may become more self magnetized, thereby causing current to be generated when it passes through deactivated toroidal electromagnetic generators.

Embodiments of the invention may also be lowered or traversed down-hole, as well as powered, by a variety of means. In some embodiments, drill pipe or coiled tubing may provide both extension and weighting of the bottom hole assembly and/or drill cutters into the hole. Drilling fluid flow (i.e. mud) through the pipe or tubing may provide power for embodiments using a pressure transfer device as discussed above. In other embodiments which employ wireline electric drilling, an electric pump, possibly in the bore hole assembly, may pressurize the secondary fluid circuit without resort to a primary fluid flow for pressure transfer.

Though embodiments of the invention have been discussed primarily in regard to initially vertical drilling in earthen formations, the systems and methods of the invention may also be used in other applications. Coring operations and particularly drilling tractors may be steered using at least portions of the invention (i.e. by control of grippers along a bore wall). Mining operations may also employ embodiments of the invention to drill horizontally curved cavities. In another alternative-use example, medical exploratory and/or correctional surgical procedures may use embodiments of the invention to access portions of bodies, both human and animal. Post-mortem procedures, for example autopsies, may also employ the systems and the methods of the invention. Other possible uses of embodiments of the invention may also include industrial machining operations, possibly where curved bores are required in a medium.

The invention has now been described in detail for the purposes of clarity and understanding. However, it will be appreciated that certain changes and modifications may be practiced within the scope of the appended claims.

What is claimed is:

1. A bottom hole assembly for drilling a cavity, wherein the bottom hole assembly comprises:

a chassis configured to rotate, wherein the chassis comprises:

a conduit configured to accept a first flow of a primary fluid;

a substantially closed loop circuit having a second flow of a secondary fluid;

a pressure transfer device configured to transfer pressure between the first flow of the primary fluid and the second flow of the secondary fluid;

a plurality of pistons operably coupled with the substantially closed loop circuit, wherein the plurality of pistons comprises a first piston, and the first piston is configured to move based at least in part on a pressure of the circuit at the first piston;

a plurality of valves operably coupled with the substantially closed loop circuit, wherein the plurality of valves is configured to control a pressure of the substantially closed loop circuit at each of the plurality of pistons and wherein each piston has an inlet and outlet valve of the plurality of valves;

a plurality of cutters in proximity to an outer surface of the chassis, wherein each of the plurality of cutters is coupled with one of the plurality of pistons; and wherein the second flow of the secondary fluid comprises a smart fluid.

2. The bottom hole assembly for drilling a cavity of claim 1, wherein at least a portion of the plurality of valves are controlled via wireline to a surface of a medium.

3. The bottom hole assembly for drilling a cavity of claim 1, wherein the pressure transfer device comprises a fluid driven pump, wherein the fluid driven pump is powered by the first flow of the primary fluid and pressurizes the second flow of the secondary fluid.

4. The bottom hole assembly for drilling a cavity of claim 3, wherein the fluid driven pump comprises a turbine, wherein the turbine is:

operably coupled with the conduit;

operably coupled with the substantially closed loop circuit;

configured to be rotated by the first flow of the primary fluid; and configured to pressurize the second flow of the secondary fluid.

5. The bottom hole assembly for drilling a cavity of claim 1, wherein:

the second flow of the secondary fluid comprises a magnetorheological fluid; and the plurality of valves comprise a plurality of magnetic field or electric field generators.

6. The bottom hole assembly for drilling a cavity of claim 1, wherein the chassis being configured to rotate comprises the chassis being configured to rotate once during a particular time period, and wherein the each of the plurality of pistons is configured to be moved at least once during the particular time period.

7. The bottom hole assembly for drilling a cavity of claim 1, wherein the bottom hole assembly further comprises a control system, and wherein the plurality of valves being configured to control a pressure of the substantially closed loop circuit at each of the plurality of pistons comprises the control system controlling the plurality of valves such that each of the plurality of pistons is extended and retracted once during a single rotation of the chassis.

8. The bottom hole assembly for drilling a cavity of claim 1, wherein the bottom hole assembly further comprises a control system, and wherein the control system is configured to:

receive data representing a rotational speed of the chassis; and control the valves based at least in part on the rotational speed of the chassis.

9. The bottom hole assembly for drilling a cavity of claim 1, wherein the first flow of the primary fluid is a mud flow.

10. The bottom hole assembly for drilling a cavity of claim 1, wherein the bottom hole assembly further comprises a control system, and wherein the control system is configured to:

receive data representing the position of the first piston; and determine an amount of wear of a cutter coupled with the first piston based at least in part on the position of the first piston.

11. The bottom hole assembly for drilling a cavity of claim 1, wherein the bottom hole assembly further comprises a control system, and wherein the control system is configured to:

transmit a first control signal to at least one of the plurality of valves in order to control a pressure of the substantially closed loop circuit at the first piston;

receive data representing a change in a position of the first piston;

determine a delay time between transmitting the first control signal and the change in position of the first piston; and transmit a second control signal at a later time, wherein the later time is based at least in part on the delay time.

12. The bottom hole assembly of claim 1 wherein extension and/or retraction of the plurality of cutters is achieved by opening or closing the inlet and outlet valve.

13. A method for drilling a cavity in a medium, wherein the method comprises:

providing a chassis having a plurality of cutters, wherein:
each of the plurality of cutters are extendable from, and retractable to, the chassis; and
the plurality of cutters comprises a first cutter;
rotating the chassis in the medium, wherein the plurality of extendable and retractable cutters remove a portion of the medium to at least partially define the cavity;
extending the first cutter from the chassis during the rotation of the chassis in the medium;
wherein extending the first cutter from the chassis during rotation of the chassis in the medium comprises:
providing a substantially closed loop circuit having a second flow of a secondary fluid;
pressurizing the second flow of a secondary fluid;
providing a plurality of pistons operably coupled with the substantially closed loop circuit, wherein:
the plurality of pistons comprises a first piston;
the first piston is configured to move based at least in part on a pressure of the substantially closed loop circuit at the first piston; and
the first cutter is coupled with the first piston;
providing a plurality of valves operably coupled with the substantially closed loop circuit, wherein the plurality of valves is configured to control a pressure of the circuit at each of the plurality of pistons and wherein each piston has an inlet and outlet valve of the plurality of valves;
controlling the plurality of valves to move the first piston; and
wherein the second flow of the secondary fluid comprises a smart fluid.

14. The method for drilling a cavity in a medium of claim 13, wherein:
the plurality of cutters further comprises a second cutter;
extending the first cutter from the chassis during the rotation of the chassis in the medium comprises extending the first cutter from the chassis when the first cutter is substantially at a particular absolute radial position; and
the method further comprises:
retracting the first cutter to the chassis when the first cutter is not substantially at the particular absolute radial position;
extending the second cutter from the chassis when the second cutter is substantially at the particular absolute radial position; and
retracting the second cutter to the chassis when the second cutter is not substantially at the particular absolute radial position.

15. The method for drilling a cavity in a medium of claim 14, wherein pressuring the second flow of a secondary fluid comprises:
providing a first flow of the primary fluid to the chassis; and
transferring pressure from the first flow of the primary fluid to the second flow of a secondary fluid.

16. The method for drilling a cavity in a medium of claim 14, wherein extending the first cutter during the rotation of the chassis in the medium comprises sending at least one control signal from a control system to the plurality of valves, and wherein the method further comprises:
receiving data representing a change in a position of the first cutter;
determining a delay time between transmitting the at least one control signal and the change in position of the first cutter; and
transmitting at least one control signal at a later time, wherein the later time is based at least in part on the delay time.

17. The method for drilling a cavity in a medium of claim 13, wherein the method further comprises:
receiving data representing the position of the first cutter; and
determining an amount of wear of the first cutter based at least in part on the data representing the position of the first cutter.

18. A system for drilling a cavity in a medium, wherein the system comprises:
a plurality of cutters;
a first means for rotating the plurality of cutters in the medium;
a second means for selectively extending and retracting each of the plurality of cutters wherein the second means comprises:
a substantially closed loop circuit having a second flow of a secondary fluid wherein the second flow of the secondary fluid comprises a smart fluid;
a plurality of pistons operably coupled with the substantially closed loop circuit, wherein each of the plurality of pistons are coupled with one of the plurality of cutters, and each piston is configured to move based at least in part on a pressure of the substantially closed loop circuit at that piston;
a plurality of valves operably coupled with the substantially closed loop circuit, wherein the plurality of valves is configured to control a pressure of the substantially closed loop circuit at each of the plurality of pistons and wherein each piston has an inlet and outlet valve of the plurality of valves; and
a third means for powering the second means.

19. The system for drilling a cavity in a medium of claim 18, wherein the first means comprises a chassis, wherein the chassis is coupled with:
the plurality of cutters; and
a rotational motion source.

20. The system for drilling a cavity in a medium of claim 18, wherein the third means comprises a pressure transfer device.

21. The system for drilling a cavity in a medium of claim 18, wherein the first means comprises an electric motor in a bottom hole assembly powered via wireline to a surface of the medium.

22. The system for drilling a cavity in a medium of claim 18, wherein the third means comprises an electric pump powered via wireline to a surface of the medium.

* * * * *